United States Patent [19]

Nolan et al.

[11] 4,033,864

[45] July 5, 1977

[54] INLET AND OUTLET APPARATUS FOR MULTIPLE MATRIX ASSEMBLY FOR MAGNETIC SEPARATOR AND MODULAR MATRIX AND MATRIX UNIT

[75] Inventors: John J. Nolan, Cambridge; Peter G. Marston, Gloucester, both of Mass.

[73] Assignee: Sala Magnetics, Inc., Cambridge, Mass.

[22] Filed: July 16, 1975

[21] Appl. No.: 596,167

[52] U.S. Cl. ..... 209/223 R; 209/231; 210/222

[51] Int. Cl.[2] ..... B03C 1/02

[58] Field of Search ..... 209/223 R, 231, 232, 209/240, 254, 488; 210/365, 222, 223; 137/597, 599; 222/189

[56] References Cited

UNITED STATES PATENTS

| | | | |
|---|---|---|---|
| 989,167 | 4/1911 | Loison | 209/355 X |
| 1,042,803 | 10/1912 | Krassa | 210/225 |
| 1,886,737 | 11/1932 | Raou | 137/597 X |
| 3,567,026 | 3/1971 | Kolm | 210/222 |
| 3,770,629 | 11/1973 | Nolan | 210/222 X |
| 3,838,773 | 10/1974 | Kolm | 210/223 X |

*Primary Examiner*—Robert Halper
*Attorney, Agent, or Firm*—Joseph S. Iandiorio

[57] ABSTRACT

A multiple matrix assembly for a magnetic separator comprising a plurality, M, of magnetic matrices arranged in a longitudinal stacked array each matrix being fed by a number, $p$, of inlets and having its product collected by a number, $p$, of outlets; at least one partition means including a transverse member between each adjacent pair of matrices; a container for receiving the matrices and the partition means; each partition means and the longitudinal ends of the container including a number of ports, P, equal to $p \times M$, arranged in M sectors with $p$ ports per sector, the pattern of ports being the same in each sector; each matrix having on each longitudinal end, $p$ sections of approximately equal area and P port positions corresponding to the P ports in the partition means, each of $p$ port positions being located at approximately the center of each of the $p$ sections, and being defined as through-put positions and the remaining $P - p$ port positions being through-holes penetrating the matrix; each of the $p$ through-put positions in any particular sector having associated with it $M - 1$ through-holes at a corresponding location one in each of the other $M - 1$ sectors.

8 Claims, 13 Drawing Figures

INLET AND OUTLET APPARATUS FOR MULTIPLE MATRIX ASSEMBLY FOR MAGNETIC SEPARATOR AND MODULAR MATRIX AND MATRIX UNIT

FIELD OF INVENTION

This invention relates to an improved inlet and outlet apparatus in a multiple matrix assembly for a magnetic separator and to an improved modular matrix and modular matrix unit for use in such an assembly.

BACKGROUND OF INVENTION

Multiple matrix magnetic separators typically use an annular electromagnetic coil or group of coils to provide a magnetic field volume in the space encompassed by the electromagnetic coils. There is a plurality of magnetic matrices arranged in a stacked array in a container within the space encompassed by the electromagnetic oil. Each magnetic matrix generally includes ferromagnetic material such as steel wool or expanddd metal enclosed in the container which may be made of stainless steel or other material of low magnetc permeability. The electromagnetic coil, matrices and container may be enclosed in a ferromagnetic return frame to increase the efficiency of the magnetic circuit. The technique of stacking magnetic matrices adjacent to each other to achieve a predetermined matrix area instead of using a single matrix of the same area is employed to reduce the volume of the ferromagnetic return frame surrounding the coil and thereby reduce the cost of the device, a significant portion of which cost is constituted by the cost of the ferromagnetic return frame. Each additional layer used in the stack to accomplish a particular area requirement reduces the diameter of the top and bottom portions of the return frame, the intermediate cylindrical portion, and the electromagnetic coil and increases the length of the coil and cylindrical portion of the frame in the longitudinal direction of slurry flow through the matrices. The number of matrices used to accomplish a particular process capacity is optimized for maximum efficiency.

Typically the flow in gallons per minute to be processed by a separator is considered in conjunction with the capacity in gallons per minute per unit area of the matrix material. From this the required matrix area is determined and depending on various other considerations that matrix area is accommodated in a stack of two or more matrices. In one approach each matrix in the stack is fed and/or has its separation produced removed via inlet and outlet pipes housed in a large circular passage extending through the center of the matrices. This approach is not wholly desirable; it removes from the separation process a substantial area of the matrix used by the passage. In addition as the size of the matrices and the flow rates increase the use of a single large centralized inlet causes problems in wear and abrasion at points where the flow is redirected for submission to the matrix. Further, the use of a single centralized inlet and outlet makes uniform flow distribution a problem. In addition the particular adaptation of each matrix to accommodate the passage and pipes typically requires that each matrix be of a particular configuration dissimilar to the other matrices. Attempts to reduce the size of the central area devoted to the inlet and outlet pipe by using a number of separate smaller pipes entering and leaving radially through the sides of the matrix have met with indifferent success. The electromagnetic coil and magnetic return frame interfere with such side access.

SUMMARY OF INVENTION

It is therefore an object of this invention to provide an improved inlet and outlet apparatus in a multiple matrix assembly for a magnetic separator which improves flow distribution to and from each matrix, reduces the amount of otherwise unusable centralized area in each matrix typically dedicated to inlet and outlet apparatus and reduces wear, abrasion and other problems associated with large diameter flow conduits.

It is a further object of this invention to provide an improved modular matrix unit and modular matrix for use with such apparatus and assembly.

The invention results from the realization that improved uniformity of flow distribution, reduction in the amount of the central area used for inlet and outlet pipes, reduction in wear and abrasion and other problems associated with large diameter flow conduits can be accomplished without the use of a plurality of radial or side access inlets and outlets but rather with a plurality of longitudinally oriented inlets and outlets in a spaced array and that such an inlet and outlet construction can be made to facilitate modular matrix units including modular matrices and modular partitions, and that a single matrix form and single partition form can be used repeatedly for each of the successive matrix units used in a multiple matrix assembly with variations in their orientation only.

In one embodiment the invention features a modular magnetic matrix for a multiple matrix assembly for a magnetic separator having M matrices, and $p$ inputs and $p$ outputs per matrix in which the matrices are arranged longitudinally in a stacked array. On each longitudinal end of the matrix there are a number of port positions P equal to $M \times p$, arranged in M sectors with $p$ port positions per sector. The pattern of port positions is the same in each sector. Each longitudinal end of the matrix has $p$ sections of approximately equal area. Each of $p$ ports positions is located at approximately the center of each of the $p$ sections and is defined as a through-put position. The remaining P—p port positions are through-holes penetrating the matrix. Each of the $p$ through-put positions in any particular sector has associated with it M—1 through-holes at a corresponding location one in each of the other M—1 sectors.

The invention also features the matrix unit which includes such a matix in combination with partition means. The partition means include a number of ports P, equal to $M \times p$, arranged in M sectors with $p$ ports per sector. The pattern of ports is the same in each sector.

The invention also features a partition for a multiple matrix assembly for a magnetic separator including M matrices and $p$ inputs and $p$ outputs per matrix; the matrices are arranged longitudinally in a stacked array. The partition includes a transverse member including a number of ports P equal to $p \times M$ arranged in M sectors with $p$ ports per sector. The pattern of ports is the same in each sector.

The invention further features a multiple matrix assembly for a magnetic separator including such a matrix and such partition means in combination with a container for receiving the matrices and the partition means.

In another embodiment the invention features a multiple matrix assembly for a magnetic separator which includes a container and a plurality of magnetic matrices arranged in a longitudinal stacked array in the container. There are inlet means at one longitudinal end of the container and outlet means at the other. The matrix at one end of the container proximate the inlet means has a though-hole aligned with the inlet means and the matrix at the other end of the container proximate the outlet means has a through-hole aligned with the outlet means. Each additional matrix includes a through-hole aligned with the inlet means and a through-hole aligned with the outlet means. Partition means are located between each pair of adjacent matrices and have a first port aligned with the inlet means and a second port aligned with the outlet means. Preferably each port in the partition aligned with the inlet means includes a sleeve extending towards the inlet means and each port in the partition aligned with the outlet means includes a sleeve extending towards the outlet means.

DISCLOSURE OF PREFERRED EMBODIMENTS

Other objects, features and advantages will occur from the following description of preferred embodiments and the accompanying drawings, in which.

Figure 1:
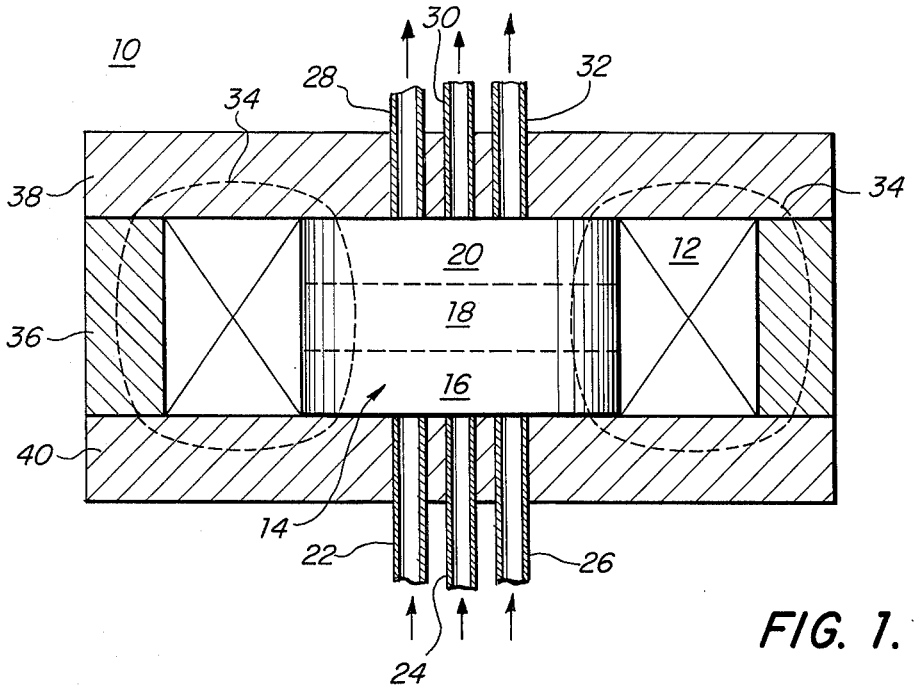
FIG. 1 is a schematic, cross-sectional diagram taken along line 1—1 of FIG. 2 of a multiple matrix magnetic separator according to this invention with the container shown in full.

There is shown in FIG. 1 a multiple matrix magnetic separator 10, including an annular electromagnetic coil 12, surrounding cylindrical container 14 containing three magnetic matrices 16, 18, and 20 which receive feed from three inlets 22, 24 and 26 and provide the products of separation to outlets 28, 30, and 32. The function of the inlets and outlets may be reversed: inlets 22, 24 and 26 may become the outlets and outlets 28, 30 and 32 may become the inlets. Electromagnetic coil 12 provides a magnetic field, lines 34, in the matrices 16, 18, and 20 which may be made, for example, of stainless steel wool. Container 14 and coil 12 may be entirely surrounded by a ferromagnetic return frame including cylindrical portion 36 and top and bottom circular plates 38 and 40.

Figure 2:
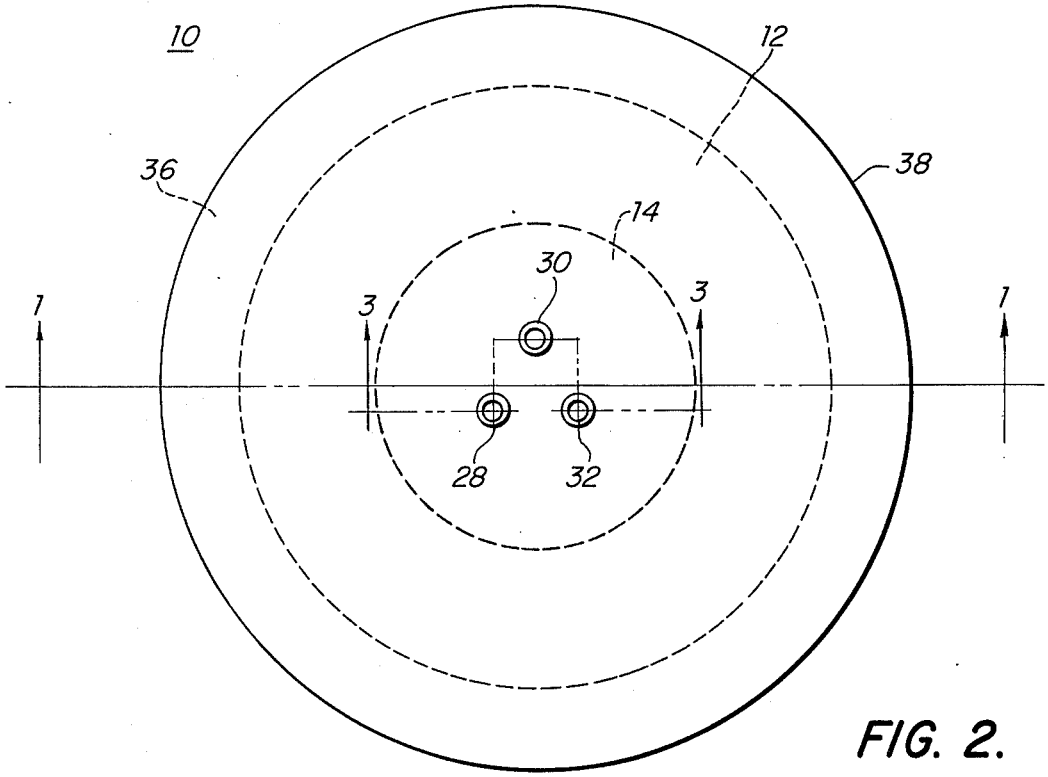
FIG. 2 is a top plan view of the separator of FIG. 1.

Inlets 22, 24 and 26 and outlets 28, 30 and 32 are disposed close to the center of container 14 in a symmetrical pattern as is apparent in FIG. 2.

Figure 3:
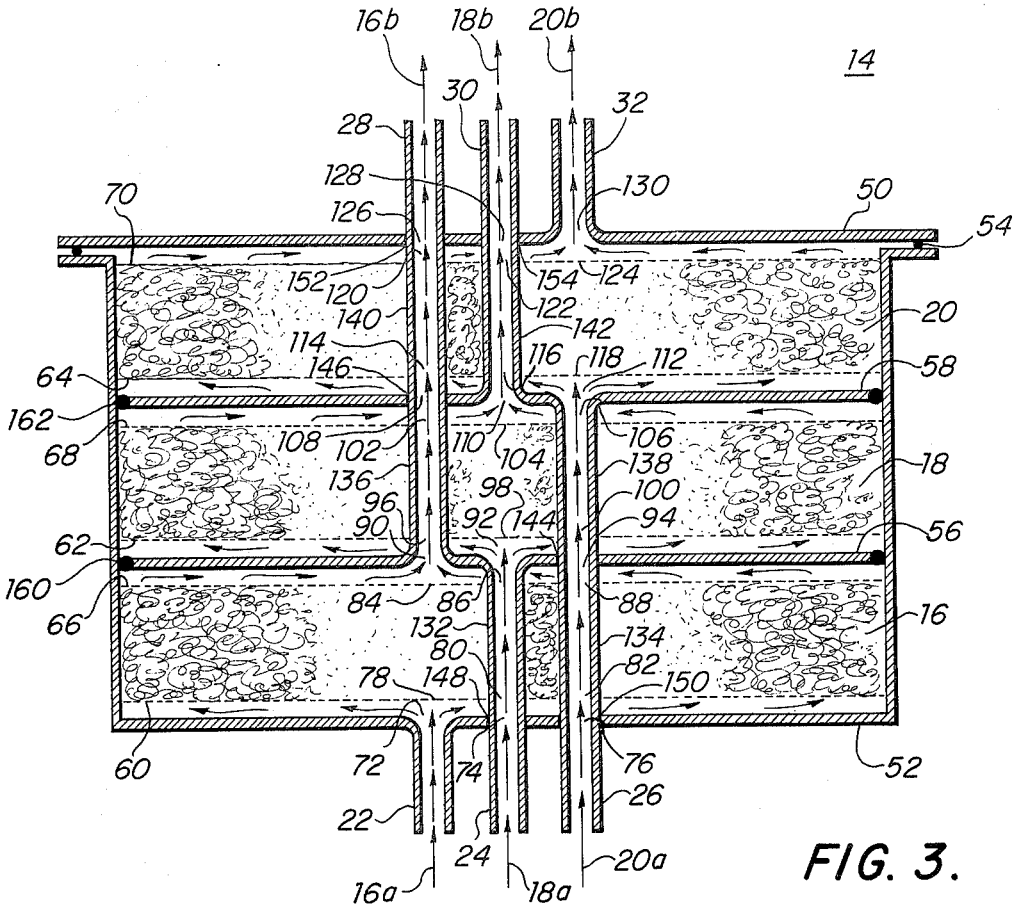
FIG. 3 is an enlarged, detailed, schematic, sectional view of the multiple matrix container of FIG. 1 taken along lines 3—3 of FIG. 2.

The multiple matrix assembly is shown in greater detail in FIG. 3 where a container 14 includes cover 50 interconnected with vessel 52 by seal 54. Matrices 16 and 18 are separated by partition 56 and matrices 18 and 20 are separated by partition 58. Inlets 22, 24 and 26 provide feed **16*a*, 18*a* , and 20*a* at relatively high pressure to the input areas 60, 62, and 64 of matrices 16, 18, and 20, all respectively; outlets 28, 30 and 32 collect the output product 16*b*, 18*b* and 20*b* at relatively low pressure from the output areas 66, 68 and 70 of matrices 16, 18 and 20,** all respectively.

The number of matrices, M, multiplied by the number, *p*, of inlets or outlets per matrix equals the total number of inlets or outlets, and the total number of port positions, P, at the top and bottom of the container, at the input and output area of each matrix, and at each partition. Thus, for example, in FIG. 3 where M equals 3 and *p* equals 1, the number of total port positions, P, is 3: there are three port positions 72, 74 and 76 in the bottom of vessel 52, three port positions 78, 80 and 82 on the input area of matrix 16, and three port positions 84, 86, and 88 on the output area of matrix 16. Likewise, partition 56 has three port positions 90, 92 and 94, while matrix 18 has three port positions 96, 98 and 100 on its input area and three port positions 102, 104 and 106 on its output area. Partition 58 has three port positions 108, 110, and 112; matrix 20 has three port positions 114, 116 and 118 on its input area and three port positions 120, 122 and 124 on its output area 70. Cover 50 has three port positions 126, 128 and 130. Since M equals 3 in this illustration, one of three port positions on the top and bottom of each matrix 16, 18 and 20 will be a through-put position where feed is delivered to the matrix, passes through it and is collected at the other side; the other M − 1 or 2 port positions on each face of each matrix are through-holes that accept the inlets 22, 24 and 26 or outlets 28, 30 and 32. For example, in matrix 16 port positions 80 and 86 define through-hole 132 in matrix 16 and port positions 82 and 88 define through-hole 134 in matrix 16, while port positions 78 and 84 in matrix 16 define the positions which are in line with inlet 22 and outlet 28. Similarly in matrix 18 port positions 96 and 102 define through-hole 136, and port positions 100 and 106 define through-hole 138, while port positions 98 and 104 define the positions proximate inlet 24 and outlet 30. Finally, in matrix 20, port positions 114 and 120 define through-hole 140 in matrix 20 and port positions 122 and 116 define through-hole 142, while port positions 118 and 124 define the positions proximate inlet 26 and outlet 32. Thus, each of matrices 16, 18 and 20 has a structure which includes two through-holes aligned with port positions while the third port position is directly in line with an inlet or an outlet.

Each partition 56 and 58 includes two conduits, one at each of two port positions and a hole for accommodating the conduit from a neighboring partition at the third post position. For example, in partition 56 port position 90 relates to outlet 28, port position 92 relates to inlet 24, and port position 94 includes a port 144 which receives inlet 26 from port position 112 of partition 58. Outlet 30 extends from port position 110 of partition 58 and port position 108 includes a port 146 which accepts outlet 28. Inlets 24 and 26 enter vessel 52 through ports 148 and 150 at port positions 74 and 76 and outlets 28 and 30 exit through cover 50 at port positions 126 and 128 through ports 152 and 154.

Figure 4:
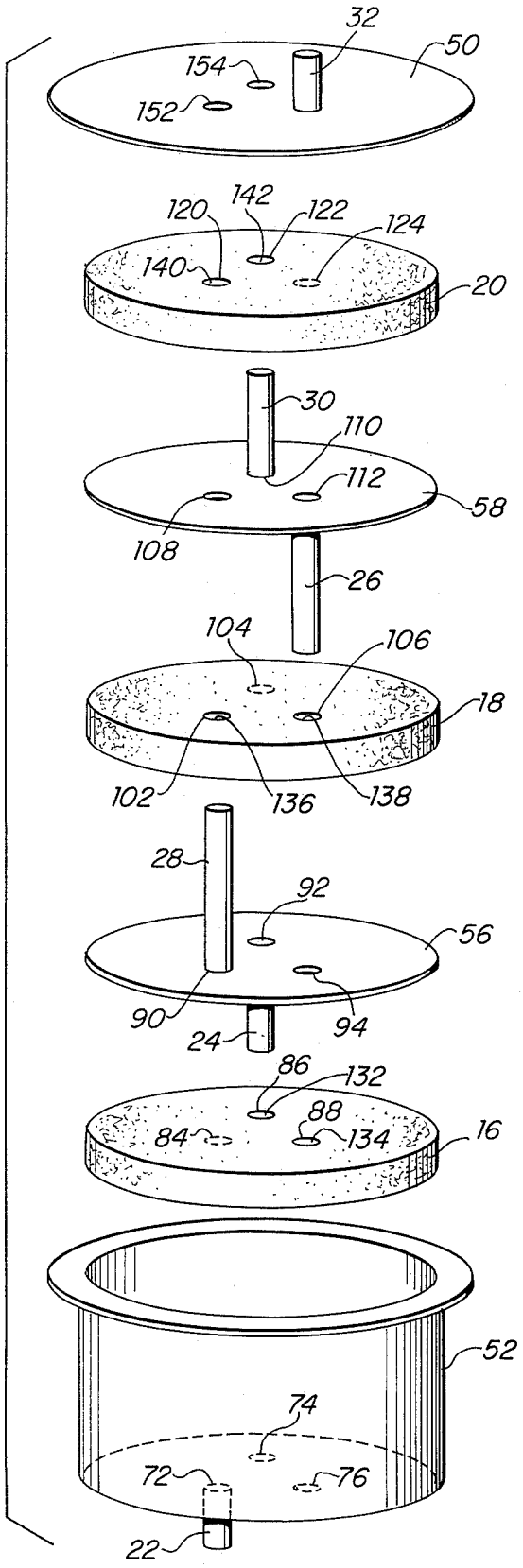
FIG. 4 is an exploded, axonometric view of the container of FIG. 3.

The modularity of the assembly of FIG. 3 can be seen more easily with respect to FIG. 4. Each side of matrices 16, 18 and 20 has two port positions which define through-holes and a third port position which defines a position opposite a feed inlet. The structure of each of matrices 16, 18 and 20 is the same. Matrix 18 is simply matrix 16 indexed 360°/M or 120° in the clockwise direction about its center. Likewise, matrix 20 is simply matrix 18 indexed 120° about its center from the position of matrix 18. Similarly, the pattern of port positions in the bottom of the container 52, in each partition 56 and 58, and in the cover 50 are precisely the same. Each of partitions 56 and 58 has an inlet connected at one port position, an outlet at a second port position, and has a port at the third port position. With respect to that arrangement, it can be observed that partition 58 in FIG. 4 contains the same structure as partition 56 but indexed 360°/M or 120°.The construction of partitions 56 and 58 is identical even though outlet 28 of partition 56 is twice as long as the corresponding outlet 30 on partition 58 and inlet 26 on partition 58 is twice as long as the corresponding inlet 24 on partition 56. That this is so can be illustrated by flipping over partition 58. so that inlet 26 corresponds in position and height to that of outlet 28 of partition 56 and outlet 30 of partition 58 corresponds in position and height to the inlet 24 of partition 56. Thus, partitions 56 and 58 are identical and only one such partition need be stocked: in one position it functions as partition 56, and inverted it functions as partition 58. Similarly, only one matrix need be stocked: the matrix with two through-holes 132 and 134 may be used as matrix 16 and the indexed to be used as matrices 18 and 20.

In the multiple matrix assembly of FIGS. 3 and 4 there arise critical sealing problems about the periphery of partitions 56 and 58 at seals 160 and 162 and at ports 144 and 146. Somewhat less critical sealing problem occur at ports 148, 150, 152 and 154. Seals 160 and 162 are particularly critical because the input feed 20*a* can leak across seal 162 to the output product 18*b*. The output will be directly contaminated with the input. The same can occur at ports 144 and 146. Seals at 148 and 150 and 152, 154 are less critical for they only provide against a loss of fluid from the machine but do not comingle the input and output.

Figure 5:
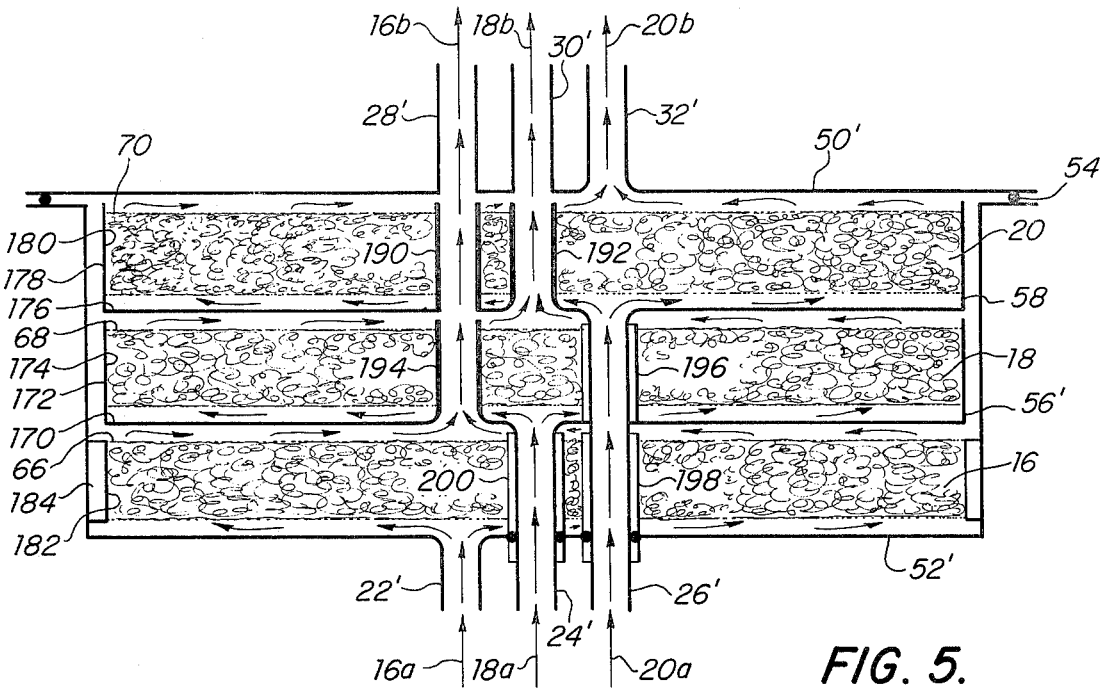
FIG. 5 is an enlarged, detailed, schematic, sectional view similar to the view of FIG. 3 of an alternative multiple matrix assembly according to this invention.

A multiple matrix assembly which simplifies the sealing problem is shown in FIG. 5 where like parts have been given like numbers and similar parts like numbers primed. In FIG. 5, partition member 56' includes a transverse member 170 and a peripheral member 172 which snugly engages with peripheral portion 174 of matrix 18; partition 58 includes a transverse member 176 with a peripheral member 178 that sealingly engages the peripheral portion 180 of matrix 20. Matrix 16 has its peripheral portion 182 sealingly engaged with a circumferential spacer 184 so that matrix 16 is equal in diameter to matrices 18 and 20. Peripheral members 172 and 178 extend up to and preferably beyond the output areas 68 and 70 of matrices 18 and 20. Thus, any of the output product which leaks over peripheral member 178, only communicates with the output product from output area 68 and leaks from either of these areas can only communicate with output product from the output area 66 of matrix 16. Thus, there is no contamination of the output product with the input. This approach is applied to the remaining leak areas by providing sleeves 190, 192, 194, 196, 198 and 200.

Figure 6:
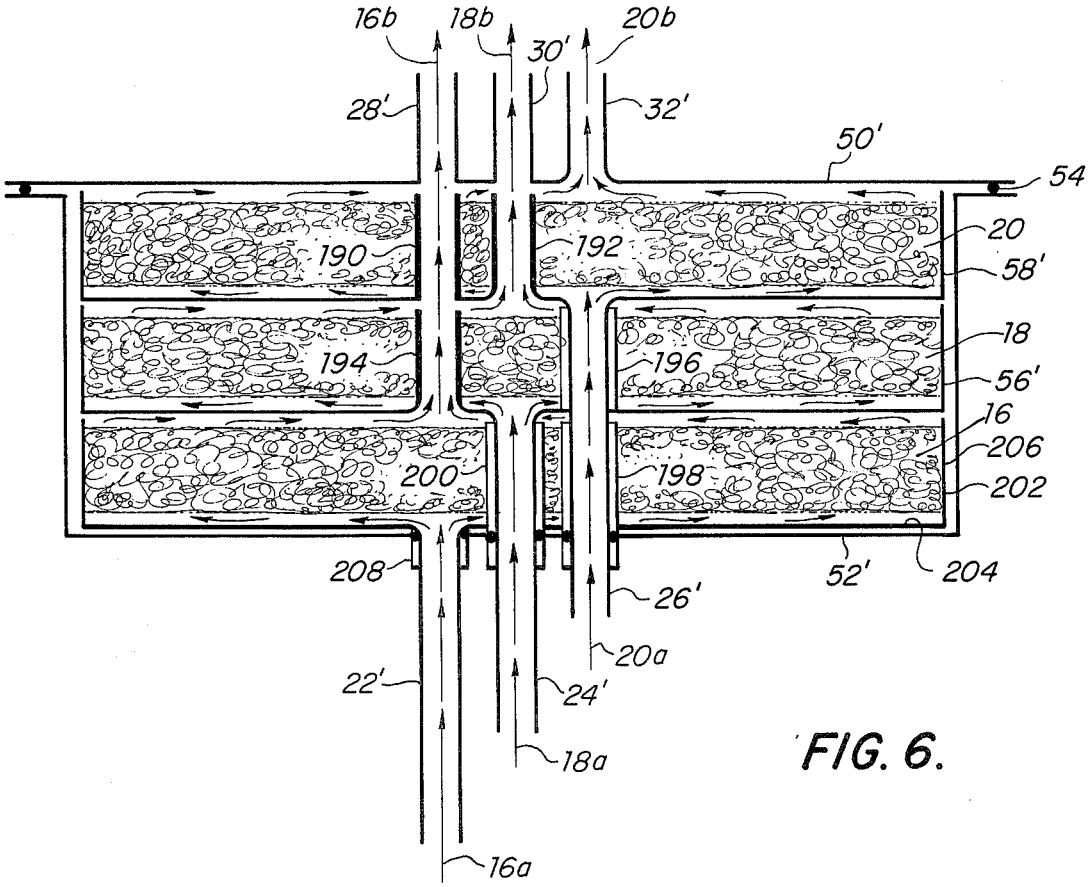
FIG. 6 is an enlarged, detailed, schematic, sectional view of a variation of the alternative multiple matrix assembly shown in FIG. 5.

In order to improve the modularity of the structure of FIG. 5, the lower matrix 16 may also be encased in a partition 202 having a transverse member 204 and peripheral member 206 as shown in FIG. 6. An additional sleeve 208 is located to received inlet 22' from transverse member 204.

Figure 7:
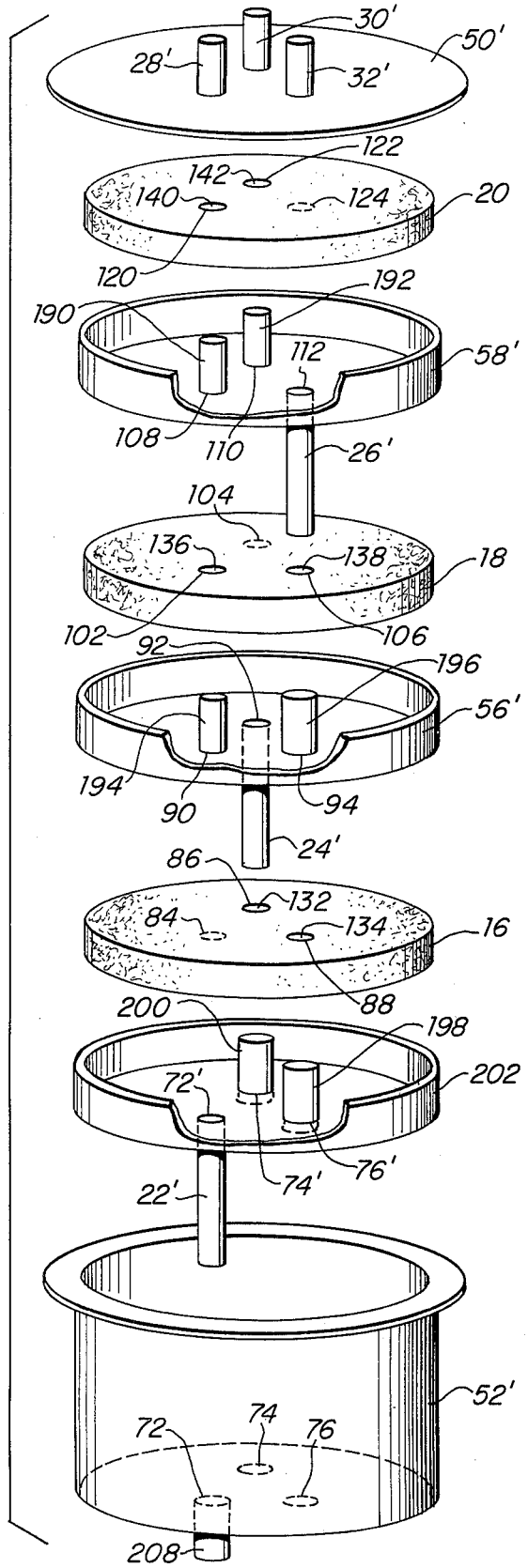
FIG. 7 is an exploded, axonometric view of the multiple matrix assembly shown in FIG. 6.

The modularity of the assembly in FIG. 6 may be seen more easily in FIG. 7 where as in FIG. 4 it is apparent that matrices 16, 18 and 20 are identical structures indexed in increments of 360°/M so that matrix 18 is the same as matrix 16 except that it is indexed 120° from the position of matrix 16. Similarly, matrix 20 is the same structure as matrix 16 except that it is rotated 240° in a clockwise direction or 120° in a counter clockwise direction from the position of matrix 16. Similarly, partitions 202, 56' and 58' are each the same basic structure with the same hole pattern. Each of partitions 202, 56' and 58' has two upstanding sleeves 198, 200, 196, 194 and 190, 192, respectively, and one downwardly extending inlet 22', 24' and 26', all respectively. Thus, partition 56' is merely partition 202 rotated 360°/M or 120° in the clockwise direction from the position at partition 202 in FIG. 7. And partition 58' is merely partition 56' rotated an additional 120° in the clockwise direction.

Figure 8:
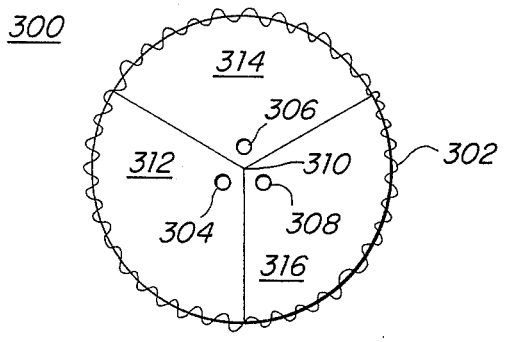
FIG. 8 is a diagram of an end of a container and of a partition means showing sectors, sections, and port positions for a single inlet triple matrix device.
Figure 9:
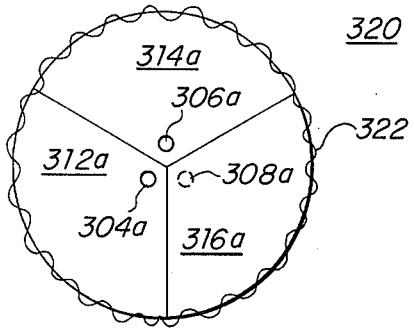
FIG. 9 is a diagram of a modular matrix showing sectors, sections, port positions, through-puts and through-holes for a single inlet triple matrix device to be used with the partition means shown in FIG. 8.

The basic structure of each modular matrix and each modular partition as well as the top and bottom of the container may be better understood with respect to FIGS. 8 and 9. Each partition and the longitudinal end of the container includes a number of ports P equal to $p \times M$ where $p$ is the number of inlets or outlets per matrix and M is the number of matrices in the assembly. Ports P are arranged in M sectors with $p$ ports per sector. The pattern of ports in each sector is the same. In FIG. 8, the diagram 300 represents the structure of a partition and of the top and bottom of a container for an assembly such as discussed with reference to FIGS. 1–7. That is, there are three matrices, M equals 3, and on inlet and outlet per matrix, $p$ equals 1; thus, P equals M times $p$ or 3.

In FIG. 8 since there is one inlet per matrix and three matrices in the assembly, each port position 304, 306 and 308 must feed the entire area of a single matrix. Thus, each of port positions 304, 306 and 308 is positioned as close as possible to the center 310 and each of port positions 304, 306, and 308 is located in a separate sector 312, 314 and 316. Preferably the sectors are equal to 360°/M, but this is not absolutely necessary. Diagram 300 shows P port positions arranged in M sectors with $p$ ports per sector and the pattern of ports in each sector is the same as that in each of the other sectors.

The matrix construction is shown in diagram 320, FIG. 9. Each side of each matrix includes a section 322, indicated by the wavey line and M port positions, port positions 304*a*, 306*a* and 308*a* located in sectors 312*a*, 314*a* and 316*a*, respectively. Two of the port positions 304*a*, 306*a* define through-holes in the matrix diagram 320 while the third port position 308*a* defines through-put or feeding and collection point to be positioned proximate an inlet or outlet.

Figure 10:
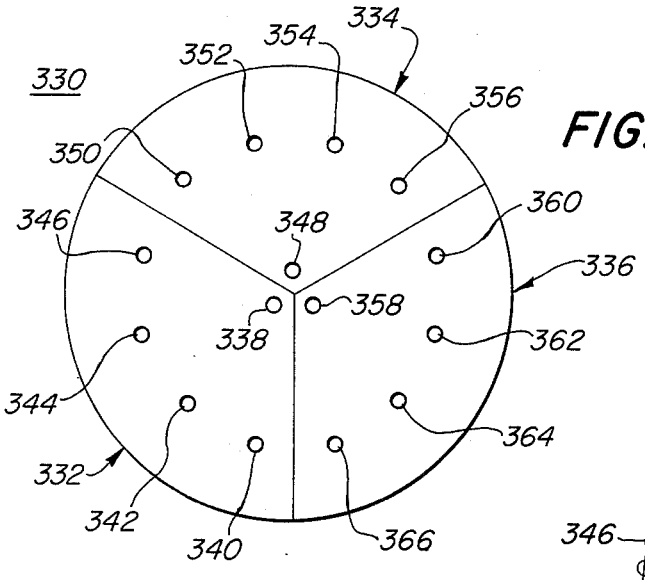
FIG. 10 is a diagram of partition means showing sections, sectors, and port positions for a five inlet triple matrix device according to this invention.

Although the invention has been described thus far only with respect to a three matrix device with one inlet and outlet per matrix where M equals 3, *p* equals 1 and P equals 3, this is not a necessary limitation of the invention. Any number of matrices and any number of inlets per matrix may be used. For example, in FIG. 10 diagram 330 indicates a partition and a top and bottom of a container for an assembly having three matrices and five outlets and inlets per matrix so that M equals 3, *p* equals 5 and P equals 15. Thus, there are three sectors 332, 334 and 336, optimally of 360°/M or 120°. Each sector contains *p*, five, port positions. Port positions 338, 340, 342, 344, 346 are located in sector 332. There are port positions 348, 350, 352, 354, and 356 located in sector 334, and there are port positions 358, 360, 362, 364 and 366 located in sector 336.

Figure 11:
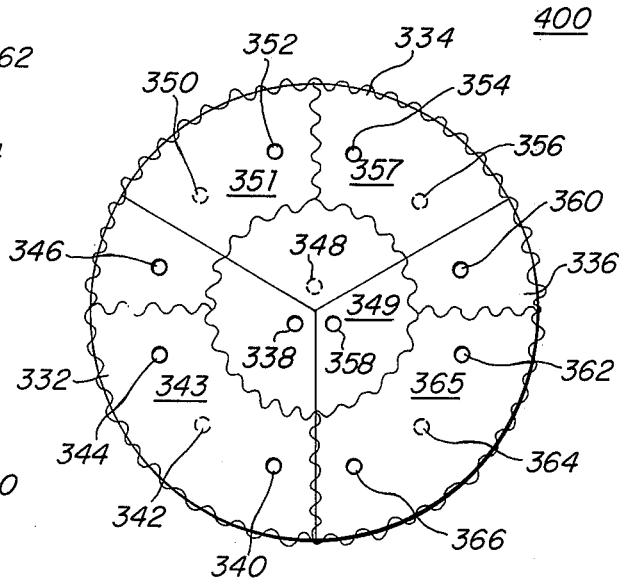
FIG. 11 is a diagram of a matrix for use with the partition means shown in FIG. 10 showing sectors, sections, port positions, through-put positions and through-holes according to this invention.

A counterpart matrix for these partition and container ends is shown in the counterpart diagram 400, FIG. 11. Port positions 350, 356, 348, 342 and 364 are defined as the through-put positions; whereas each of the remaining port positions 352 354, 360, 362, 366, 358, 340, 338, 344, and 346 are through-holes which accept various ones of the sleeves, inlets and outlets. Thus, each matrix may be structured as shown in FIG. 11 and then indexed 360°/M or 120° clockwise or counterclockwise. In diagram 400 each of the *p*, 5, through-put positions 350, 356, 348, 364, and 342 has associated with it a through-hole at a corresponding location, one in each of the other M−1, or two sectors. Thus, through-put position at port position 350, in sector 334 requires that corresponding port positions 360 in sector 336 and 340 in sector 332 be through-holes.

The through-put position at port position 356, requires that there be through-holes as corresponding port positions 366, 346 in sectors 336 and 332, respectively. A through-put position at port position 348 in sector 334 requires that there be through-holes at corresponding port positions 358 and 338 in sectors 336 and 332, respectively. Similarly, a through-put position at port position 364 requires that there be a through-hole at corresponding port positions 344 and 354 in sectors 332 and 334, respectively; and a through-put position at port position 342 requires that there be a through-hole at corresponding port positions 352 and 362 in sectors 334 and 336, respectively. Matrix diagram 400 illustrates the structure of each of the three matrices in the assembly which may be assembled and then merely indexed or rotated preferably approximately 360°/M or 120° for optimum performance.

Each of through-put port positions 350, 356, 364, 342 and 348 is located at approximately the center of approximately equal area sections 351, 357, 365, 343 and 349.

Figure 12:
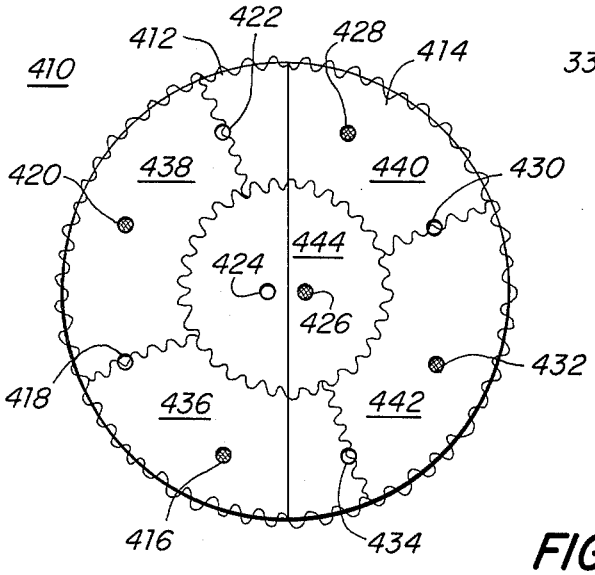
FIG. 12 is a diagram of a matrix for a five inlet, two matrix device according to this invention showing sectors, sections, port positions, through-puts, and through-holes according to this invention.

In FIG. 12 there is shown a matrix diagram for a multiple matrix assembly in which M equals 2 and *p* equals 5. Diagram 410, FIG. 12, includes two sectors 412, 414 and there are 10 port positions, five 416, 418, 420, 422 and 424 in sector 412, and five 426, 428, 430, 432 and 434 in sector 414.

Five of the port positions are through-put positions, i.e., 416, 420, 428, 432 and 426 and are located at the approximate center of five approximately equal areas, sections 436, 438, 440, 442 and 444.

All of the port positions in diagram 410 correspond to actual holes in the top and bottom of the container and in each partition. Cross-hatched holes at port positions 426, 428, 432, 416 and 420 indicate through-put positions while the remaining five port positions define through-hole positions in the matrix. Instead of indexing or rotating the two matrices by 360°/M or 180° to complete the assembly, an alternative approach may be used. That is, one of the matrices may be flipped over or inverted so that it is upside-down relative to the other matrix. Thus, each of the through-put positions has a through-hole in a corresponding position in the other sector. For example, through-put port position 428 in sector 414 has a corresponding through-hole at port positon 422 in sector 412. Through-put port position 426 in sector 414 has a corresponding through-hole port position 424 in sector 412. Through-put port position 432 in sector 414 has a corresponding through-hole port position 418 in sector 412. Similarly, through-put port position 416 in sector 412 has a corresponding through-hole port position 434 in sector 414 and through-hole port position 420 in sector 412 has a corresponding through-hole port position 430 in sector 414. And the same result occurs when the matrix is inverted or flipped over. In some applications combinations of inverting the indexing may be used.

This invention, even though herein illustrated with small matrices having only a few ports and a few matrices, is most applicable in machines using many ports and large matrices, e.g., 30 inches, 80 inches or 100 inches or more in diameter. For optimum performance it is desirable that the port positions be uniformly spaced from one another as well as being positioned at approximately the center of approximately equal areas. While in smaller machines using only a few inlets and outlets this may not be a critical consideration, it may well become critical in cases of large machines which process millions of gallons of fluid each day and may require a hundred or two hundred or more inlet pipes and outlet pipes. For this purpose it is useful, but not a necessary limitation of the invention that each of the sectors be approximately equal in size; but if this is not a possibility, there should at least be the same number of sectors as there are matrices in the assembly.

The structures described in FIGS. 1–12 facilitate matching input flow in gallons per minute, input pressures and other parameters to each of the separate sections fed by separate inlets in order to accommodate non-uniformities in the packing density, arrangement, fiber construction or other conditions in each matrix.

Figure 13:
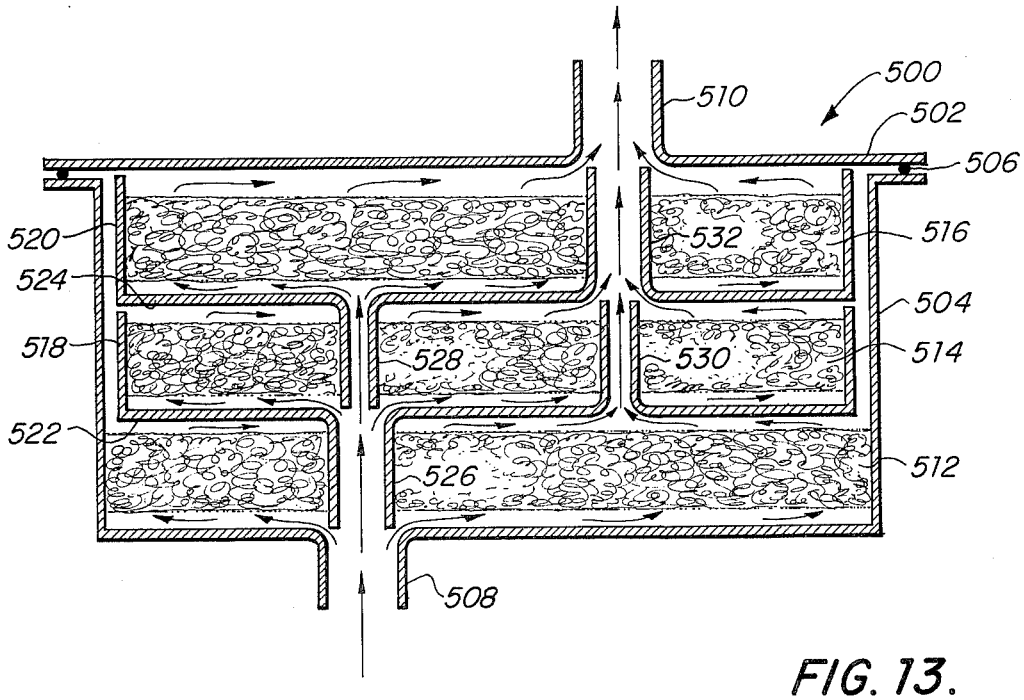
FIG. 13 is an enlarged, detailed, schematic sectional view of an alternative embodiment of a multiple matrix assembly having a single inlet and outlet for supplying a plurality of matrices.

However, where such considerations are not a problem or where the matrices are completely uniform in all respects a simpler, alternative embodiment may be used, as shown in FIG. 13. Container 500 including cover 502 attached to vessel 504 by seal 506 includes but one inlet 508 and one outlet 510. Matrix 512 fits snugly up against the walls of vessel 504; matrices 514 and 516 fit snugly up against the peripheral members 518 and 520 of partitions 522 and 524, respectively. Each partition includes an inlet 526, 528 aligned with inlet 508 and an outlet 530, 532 aligned with outlet 510. The matrix at the inlet end, matrix 512, includes a single through-hole for accommodating inlet 526; matrix 516, at the outlet end of the container includes one through-hole for accommodating outlet 532. All the remaining matrices disposed between these two matrices will have one through-hole for accommodating an inlet and another for accommodating an outlet. In FIG. 13 there is but one additional matrix, matrix 514, which includes two through-holes for accommodating inlet 528 and outlet 530. Thus in the assembly of FIG. 13 each partition means is identical with respect to the port positions, although not always with respect to the diameter of the inlets or sleeves. Similarly, the matrices at either end of the container are identical with respect to the position of the through-holes while each of the additional matrices used between those two matrices is identical with respect to the position of its through-holes. Although the arrangement illustrated in FIG. 13 shows but one inlet means and one outlet means, this is not a necessary limitation of the invention. Two or more such inlets and outlets may be used with a corresponding increase in the number of ports and through-holes.

Other embodiments will occur to those skilled in the art and are within the following claims:

What is claimed is:

1. A multiple matrix assembly for a magnetic separator comprising:

a plurality, M, of magnetic matrices arranged in a longitudinal stacked array, each matrix being fed by a number, $p$, of inlets and having its product collected by a number $p$ of outlets;

at least one partition means including a transverse member between each adjacent pair of said matrices;

a container for receiving said matrices and said partition means;

each said partition means and the longitudinal ends of said container including a number of ports P equal to $p \times M$, arranged in M sectors with $p$ ports per sector, the pattern of ports being the same in each sector;

each said matrix having on each longitudinal end, $p$ sections of approximately equal area and P port positions corresponding to said P ports in said partition means, each of $p$ of said P port positions being located at approximately the center of each of said p sections, respectively, and being defined as through-put positions and the remaining $P - p$ port positions being through-holes penetrating said matrix; each of said $p$ through-put positions in any particular sector having associated with it M−1 through holes at a corresponding location one in each of the other M−1 sectors.

2. The multiple matrix assembly of claim 1 in which said partition means further include a peripheral member extending longitudinally from said transverse member for sealingly engaging the peripheral portion of said matrix.

3. The multiple matrix assembly of claim 1 in which each said sector has an angular extent of 360°/M.

4. A matrix unit for a multiple matrix assembly for a magnetic separator having M matrices and $p$ inputs and $p$ outputs per matrix in which the matrix units are arranged longitudinally in a stacked array, comprising:

partition means including a number of ports P, equal to $M \times p$, arranged in M sectors with $p$ ports per sector, the pattern of ports being the same in each sector; and a magnetic matrix having on each longitudinal end $p$ sections of approximately equal area and P port positions corresponding to said P ports in said partition means, each of $p$ of said P port positions being located at approximately the center of each of said p sections, respectively, and being defined as through-put positions and the remaining P−$p$ port positions being through-holes penetrating said matrix; each of said $p$ through-put positions in any particular sector having associated with it M−1 through-holes at a corresponding location one in each of the other M−1 sectors.

5. The multiple matrix assembly of claim 4 in which said partition means further include a peripheral member extending longitudinally from said transverse member for sealingly engaging the peripheral portion of said matrix.

6. The multiple matrix assembly of claim 4 in which each said sector has an angular extent of 360°/M.

7. A magnetic matrix for a multiple matrix assembly for a magnetic separator having M matrices and $p$ inputs and $p$ outputs per matrix in which the matrices are arranged longitudinally in a stacked array comprising: on each longitudinal end of said matrix a number of port positions P equal to $M \times p$, arranged in M sectors with $p$ port positions per sector, the pattern of $p$ port positions being the same in each sector; each longitudinal end of said matrix having $p$ sections of approximately equal area; each of $p$ of said P port positions being located at approximately the center of each of $p$ sections, respectively, and the remaining P−$p$ port positions being through-holes penetrating said matrix; each of said $p$ through-put positions in any particular sector having associated with it M−1 through-holes at a corresponding location one in each of the other M−1 sectors.

8. A multiple matrix assembly for a magnetic separator comprising:

a container;

a plurality of magnetic matrices arranged in a longitudinal stacked array in said container;

at least one inlet means at one longitudinal end of said container and at least one outlet means at the other;

the matrix at one end of said container proximate said inlet means having a through-hole aligned with each said inlet means, and the matrix at the other end of said container proximate said outlet means having a through-hole aligned with each said outlet means, each additional matrix including a through-hole aligned with each said inlet means and a through-hole aligned with each said outlet means;

partition means between each pair of adjacent matrices having a port aligned with each said inlet means and a port aligned with each said outlet means; and each said port in a said partition aligned with each said inlet means includes a sleeve extending toward each said inlet means, respectively, and each said port in a said partition aligned with each said outlet means includes a sleeve extending toward each said outlet means, respectively.

* * * * *